US005366841A

United States Patent [19]

Patel et al.

[11] Patent Number: 5,366,841

[45] Date of Patent: * Nov. 22, 1994

[54] TONER AGGREGATION PROCESSES

[75] Inventors: Raj D. Patel, Oakville; Grazyna E. Kmiecik-Lawrynowicz, Burlington; Michael A. Hopper, Toronto; Melvin D. Croucher, Oakville, all of Canada

[73] Assignee: Xerox Corporation, Stamford, Conn.

[ * ] Notice: The portion of the term of this patent subsequent to Nov. 15, 2011 has been disclaimed.

[21] Appl. No.: 129,476

[22] Filed: Sep. 30, 1993

[51] Int. Cl.[5] ..... G03G 9/08

[52] U.S. Cl. ..... 430/137; 523/322; 523/335; 523/339

[58] Field of Search ..... 430/137; 523/322, 335, 523/339

[56] References Cited

U.S. PATENT DOCUMENTS

| | | | |
|---|---|---|---|
| 4,137,188 | 1/1979 | Uetake et al. . | |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |

*Primary Examiner*—Roland Martin
*Attorney, Agent, or Firm*—E. O. Palazzo

[57] ABSTRACT

A process for the preparation of toner compositions comprising:

(i) preparing a pigment dispersion in water, which dispersion is comprised of a pigment, an ionic surfactant and optionally a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water, and surfactant;

(iii) heating the above sheared blend at a critical temperature region about equal to or above the glass transition temperature (Tg) of the resin, while continuously stirring, to form electrostatically bounded toner size aggregates with a narrow particle size distribution and wherein said critical temperature is from about 0° C. to about 10° C. above the resin Tg, and wherein the resin Tg is from about 30° C. to about 65° C. and preferably in the range of from about 45° C. to about 65° C.;

(iv) heating the statically bound aggregated particles from about 10° C. to about 45° C. above the Tg of the resin particles to provide a toner composition comprised of polymeric resin, pigment and optionally a charge control agent; and (v) optionally separating and drying said toner.

21 Claims, No Drawings

TONER AGGREGATION PROCESSES

BACKGROUND OF THE INVENTION

The present invention is generally directed to toner processes, and more specifically to aggregation and coalescence processes for the preparation of toner compositions ! n embodiments, the present invention is directed to the preparation of toners without the utilization of the known pulverization and/or classification methods, rendering the present process economical and wherein toner compositions with a volume average diameter of from about 1 to about 25, and preferably from 5 to about 15 microns in volume average diameter and narrow GSD of, for example, from about 1.18 to about 1.26 as measured on the Coulter Counter, can be obtained. The resulting toners can be selected for known electrophotographic imaging and printing processes, including color processes, and lithography. In embodiments, the present invention is directed to a process comprised of dispersing a pigment and optionally a charge control additive and other known toner additives in an aqueous mixture containing an ionic surfactant in amount of from about 0.5 percent (weight percent throughout unless otherwise indicated) to about 10 percent and shearing this mixture with a latex mixture comprised of suspended resin particles of from, for example, about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in amount of from 1 percent to about 5 percent, thereby causing a flocculation of resin particles, pigment particles and optional charge control particles, followed by heating in a sensitive critical region of the resin Tg, where the temperature is in the range of from about 0° C. to about 10° C., and preferably about 5 to about 8° C. above the resin Tg while stirring of the flocculent mixture, which is believed to form statically bound aggregates of from about 4 microns to about 15 microns in average volume diameter comprised of resin, pigment and optionally charge control particles, and thereafter coalescing the aggregated particles. The size of the aforementioned statistically bonded aggregated particles increases as the temperature in this heating stage is increased in the range of 0° C. to about 10° C. of the resin Tg. The aggregating of submicron latex and pigment particles is believed to be a kinetically controlled process. Since the aggregation is performed at temperatures about equal or above the resin Tg, the aggregation process is hence rendered very sensitive and careful temperature control is essential. The higher the temperature of the stirring to form the aggregates the bigger the particle size, for example at 50° C. a particle size of about 6 microns is obtained, while at temperatures of 62° C. a particle size of about 10 microns is obtained with narrow particle size distribution in a very short time, for example from 1 to 3 hours when the aggregation is performed at a temperatures of minus 5° C. of the resin Tg, while at aggregation temperature in the range of about 8° C. the time is from 1 to about 1.5 hours. Subsequently, the mixture is heated to generate toner particles with an average particle volume diameter of from about 1 to about 10 microns. It is believed that during the heating stage, tire components of aggregated particles fuse together to form composite toner particles. In another embodiment thereof, the present invention is directed to an in situ process comprised of first dispersing a pigment, such as HELIOGEN BLUE TM or HOSTAPERM PINK TM, in an aqueous mixture containing a cationic surfactant, such as benzalkonium chloride (SANIZOL B-50 TM), utilizing a high shearing device, such as a Brinkman Polytron or microfiuidizer or sonicator, thereafter shearing this mixture with a latex of suspended resin particles, such as poly(styrene butadiene acrylic acid), poly(styrene butyl acrytate acrylic acid) or PLIOTONE TM, a poly(styrene butadiene), and which particles are, for example, of a size ranging from about 0.01 to about 0.5 micron in average volume diameter as measured by the Brookhaven nanosizer in an aqueous surfactant mixture containing an arionic surfactant such as sodium dodecylbenzene sulfonate, for example NEOGEN R TM or NEOGEN SC TM, and nonionic surfactant such as alkyl phenoxy poly(ethylenoxy)ethanol, for example IGEPAL 897 TM or ANTAROX 897 TM, thereby resulting in a flocculation, or heterocoagulation of the resin particles with the pigment particles; arid which on further stirring while heating results in the formation of statically bound aggregates ranging in size of from about 5 microns to about 15 microns in average diameter size as measured by the Coulter Counter (Microsizer II) where the size of aggregated particles is controlled by heating in the very sensitive regions to the resin Tg, for example in the range of 54° C. to 64° C. The process of heating in the range of 0° C. to 10° C. above the resin Tg to form statically bound aggregates is accomplished for an effective time of, for example, preferably about 1 to 1.5 hours. The aforementioned toners are especially useful for the development of colored images with excellent line and solid resolution, and wherein substantially no background deposits are present. While not being desired to be limited by theory, it is believed that the flocculation or heterocoagulation is caused by the neutralization of the pigment mixture containing the pigment and cationic surfactant absorbed on the pigment surface with the resin mixture containing the resin particles and anionic surfactant absorbed on the resin particle. This process is kinetically controlled and an increase, for example, from about 54° C. to 64° C. in temperature increases the flocculation, and hence aggregated particle size from about 5 to 10 microns while achieving a narrow particle size distribution providing, for example, a GSD of about 1.20. Thereafter, heating the aggregates, for example 11 to 50° C. above the resin Tg, fuses the aggregated particles or coalesces the particles to enable the formation of toner composites of polymer and pigments, and optionally charge control agents. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing; and thereby forming statically bounded aggregate particles by stirring and heating in the critical sensitive regions of the resin Tg, for example in the range of 50° C. to 65° C. and specifically in the range of 54° C. to 64° C., and thereafter, that is when the aggregates are formed, heating in the range of 11° C. to 50° C. above the resin Tg to form stable toner composite particles. Of importance with respect to the processes of the present invention in embodiments is computer controlling the temperature of the heating to form the aggregates, since the temperature affects the rate of aggregation, the size of the aggregates and the particle size distribution of aggregates.

In reprographic technologies, such as xerographic and ionographic devices, toners with volume average diameter particle sizes of from about 9 microns to about 20 microns are effectively utilized. Moreover, in some xerographic technologies, such as the high volume Xerox Corporation 5090 copier duplicator, high resolution characteristics and low image noise are highly desired, and can be attained utilizing the small sized toners of the present invention with, for example, a volume average particle of 5 to 15 microns and preferably less 5 to 9 microns and with narrow geometric size distribution (GSD) of from about 1.16 to about 1.3. Additionally, in some xerographic systems wherein process color is utilized such as pictorial color applications, small particle size colored toilers of from about 3 to about 9 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to about 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 4 to about 7 microns, and with higher pigment loading such as from about 5 to about 12 percent t3y weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures, such as from about 120 to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners of from about 3 to about 5 microns and fixing thereafter results in a low gloss toner image of from about 1 to about 30 gloss units as measured by the Gardner Gloss metering unit. Alternatively, if higher image gloss is desired, such as from greater than about 30 to about 60 gloss units as measured by the Gardner Gloss metering unit, higher gloss paper is utilized such as from greater than about 30 to about 60 gloss units.

Numerous processes are known for the preparation of toners, such as, for example, conventional processes wherein a resin is melt kneaded or extruded with a pigment, micronized and pulverized to provide toner particles with an volume average particle diameter of from about 9 microns to about 20 microns and with broad geometric size distribution of from about 1.4 to about 1.7. In such processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 5 microns to about 10 microns, lower toner yields are obtained after classification, such as from about 50 percent to about 70 percent. With the processes of the present invention, in embodiments small average particle sizes of, for example, from about 5 microns to about 12 microns, are attained without resorting to classification processes, and narrow geometric size distributions are attained, such as from about 1.16 to about 1.26. High toner yields are also attained such as from about 90 percent to about 98 percent in embodiments. In addition, by the toner particle preparation process of the present invention in embodiments, small particle size toners of from about 5 microns to about 10 microns can be economically prepared in high yields such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer such as acrylic acid in the emulsion resin is necessary, and toner preparation is not obtained without the use, for example, of acrylic acid polar group, see Comparative Example I. The process of the present invention does not need to utilize polymer polar acid groups, and toners can be prepared with resins such as poly(styrenebutadiene) or PLIOTONE TM without containing polar acid groups. Additionally, the process of the '127 patent does not utilize counterionic surfactant and flocculation process as does the present invention, and does not use a counterionic surfactant for dispersing the pigment. In U.S. Pat. No. 4,983,488, a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate which results in the formation of particles with wide GSD. Furthermore, the '488 patent does not disclose the process of counterionic, for example controlled aggregation is obtained by changing the counterionic strength, flocculation of the present invention. Similarly, the aforementioned disadvantages, for example poor GSD are obtained, hence classification is required resulting in low yields, are illustrated in other prior art, such as U.S. Pat. No. 4,797,339, wherein there is disclosed a process for the preparation of toners by resin emulsion polymerization, wherein similar to the '127 patent polar resins of opposite charges are selected, and wherein flocculation as in the present invention is not disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including the effective preparation of small toner particles with narrow particle size distribution as a result of no classification; yields of toner are high; large amounts of power consumption are avoided; the process can be completed in rapid times therefore rendering it attractive and economical; and it is a controllable process since the particle size of the toner can be tightly controlled by controlling the temperature of the aggregation.

In now U.S. Pat No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. Additionally, there is disclosed in copending application U.S. Ser. No. 936,471, now U.S. Pat. No. 5,278,028, the disclosure of which is totally incorporated herein by reference, a process for the preparation of in situ toners comprising a halogenization procedure which chlorinates the outer surface of the toner and results in enhanced blocking properties. More specifically, this patent application discloses an aggregation process wherein a pigment mixture containing an ionic surfactant is added to a resin mixture containing polymer resin particles of less than 1 micron nonionic and counterionic surfactant, and thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter and narrow geometric size distribution of from about 1.2 to about 1.4, as measured by the Coulter Counter, and which exhibit, for example, low fixing temperature of from about 125° C. to about 150° C., low paper curling, and image to paper gloss matching.

In U.S. Pat. No. 5,308,734 (D/92576), the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of the ionic surfactant, homogenizing and stirring the mixture, and heating to provide for coalescence of the toner fine particles.

In copending patent application U.S. Ser. No. 082,651, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of the ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating the toner; and (vi) drying the toner.

In copending patent application U.S. Ser. No. 083,146, the disclosure of which is totally incorporated herein by reference, there is illustrated a process for the preparation of toner compositions with a volume median particle size of from about 1 to about 25 microns, which process comprises:

(i) preparing by emulsion polymerization an anionic charged polymeric latex of submicron particle size, and comprised of resin particles and anionic surfactant;

(ii) preparing a dispersion in water, which dispersion is comprised of optional pigment, an effective amount of cationic flocculant surfactant, and optionally a charge control agent;

(iii) shearing the dispersion (ii) with the polymeric latex thereby causing a flocculation or heterocoagulation of the formed particles of optional pigment, resin and charge control agent to form a high viscosity gel in which solid particles are uniformly dispersed;

(iv) stirring the above gel comprised of latex particles, and oppositely charged dispersion particles for an effective period of time to form electrostatically bound relatively stable toner size aggregates with narrow particle size distribution; and (v) heating the electrostatically bound aggregated particles at a temperature above the resin glass transition temperature (Tg) thereby providing a toner composition comprised of resin, optional pigment and optional charge control agent.

In copending patent application U.S. Ser. No. 083,157, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5 to about 50° C. above about the resin glass transition temperature, Tg, which resin Tg is from between about 45 to about 90° C. and preferably from between about 50 and about 80° C., the statically bound aggregated particles to form said toner composition comprised of resin, pigment and optional charge control agent.

In copending patent application U.S. Serial No. 082,741, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating the toner particles from water and surfactants; and (vi) drying the toner particles.

In copending patent application U.S. Ser. No. 082,660, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In copending patent application U.S. Serial No. 083,116, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5 to about 25° C. below about the glass transition temperature (Tg) of the resin while continuously stirring to form toner sized aggregates with a narrow size dispersity; and (iv) heating the electrostatically bound aggregated particles at a temperature of from about 5 to about 50° C. above about the Tg of the resin to provide a toner composition comprised of resin, pigment and optionally a charge control agent.

There are a number of differences of the processes of the present invention compared to those illustrated in the aforementioned copending patent applications including, for example, the following. Different particle sizes especially 5 microns and up, for example in the range of 5 to 15 microns, can be prepared by altering the aggregation temperature (step iii) where the temperature is in the sensitive critical region of the resin Tg, which is, for example, between 54 and 64° C. Another advantage of the present invention is that the latex solids comprised of resin and pigment particles concentration does not need to be reduced in embodiments, for example from 12 percent down to 6 percent. In the present invention, the latex concentration can be retained in embodiments at about 12 percent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture containing pigment particles, and optionally charge control agents and other known optional additives dispersed in a water containing a cationic surfactant by shearing, microfluidizing or ultrasonifying; (ii)shearing the pigment mixture with a latex mixture comprised of a polymer resin, anionic surfactant and nonionic surfactant thereby causing a flocculation of latex particles with pigment particles or heterocoagulation, which on further stirring while heating in the sensitive regions of the resin Tg allows for the formation of electrostatically stable aggregates of from about 5 to about 10 microns in average volume diameter as measured by the Coulter Counter; (iii) adding extra, for example, 1 to 10 percent anionic or nonionic, surfactant to the formed aggregates to, for example, increase their stability and to retain the particle size and particle size distribution during the heating stage; and (iv) coalescing or fusing the aforementioned aggregated particle mixture by heat to toner composites, or a toner composition comprised of resin, pigment, and charge additive.

In a further object of the present invention there is provided a process for the preparation of toner particles with a volume average diameter of from between about 5 to about 12 microns, and with a narrow GSD of from about 1.16 to about 1.26.

In a further object of the present invention there is provided a process for the preparation of toner compositions with particle size which can be controlled by controlling the temperature of the aggregation in the very sensitive regions of the resin Tg where the temperature range is between 0° C. to plus 10° C. of the resin Tg while stirring.

In a further object of the present invention there is provided a process for the preparation of toner particles by performing the aggregation above the resin Tg for a short period of time, normally in the range of about 1 to about 1.5 hours.

Moreover, in a further object of the present invention there, is provided a process for the preparation of toner compositions which after fixing to paper substrates result in images with a gloss of from 20 GGU (Gardner Gloss Units) up to 70 GGU as measured by Gardner Gloss meter matching of toner and paper.

In another object of the present invention there are provided polar or nonpolar toner compositions in high yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of latex particles with pigment particles dispersed in water and surfactant, and wherein the aggregated particles of toner size can then be caused to coalesce by, for example, heating. In embodiments, factors of importance with respect to controlling particle size and particle size distribution include the concentration of the surfactant used for the pigment dispersion, the concentration of the resin component like acrylic acid in the latex, the temperature of coalescence, and the time of coalescence.

Also, in another embodiment of the present invention there are provided toner processes for tuning the particle size of the toner resulting by conducting the aggregation part of the process at temperatures in the onset/-midpoint/offset glass transition range temperature of the latex resin selected.

These and other objects of the present invention are accomplished in embodiments by the provision of toners and processes thereof. In embodiments of the present invention, there are provided processes for the economical direct preparation of toner compositions by improved flocculation or heterocoagulation and coalescence processes, and wherein the temperature of aggregation can be utilized to control the final toner particle size, that is volume average diameter.

In embodiments, the present invention is directed to processes for the preparation of toner compositions which comprises initially attaining or generating an ionic pigment dispersion, for example dispersing an aqueous mixture of a pigment or pigments such as carbon black, like REGAL 330®, phthalocyanine, quinacridone or RHODAMINE B™ type with a cationic surfactant such as benzalkonium chloride by utilizing a high shearing device such as a Brinkman Polytron, thereafter shearing this mixture by utilizing a high shearing device such as a Brinkman Polytron, a sonicator or microfluidizer with a suspended resin mixture comprised of polymer particles, such as poly(styrene butadiene) or poly(styrene butylacrylate) and wherein the particle size of the suspended resin mixture ranges from about 0.01 to about 0.5 micron, in an aqueous surfactant mixture containing an anionic surfactant such as sodium dodecylbenzene sulfonate and nonionic surfactant; resulting in a flocculation, or heterocoagulation of the resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating in the temperature range of 0 to about 10° C., and preferably 5 to 8° C. above the resin Tg allowing the formation of electrostatically stabilized aggregates ranging from about 5 microns to about 10 microns; followed by heating above the resin Tg, for example from about 10, preferably 15 to about 50° C., to cause the coalescence of the latex pigment particles; and followed by washing with, for example, hot water to remove, for example, surfactant; and drying such as by use of an Aeromatic fluid bed dryer, freeze dryer, or spray dryer; whereby toner particles comprised of resin and pigment ,with various particle size diameters can be obtained, such as from about 5 to about 15 microns in volume average particle diameter as measured by the Coulter Counter.

Embodiments of the present invention include a process for the preparation of toner compositions comprised of resin and pigment comprising (i) preparing a pigment dispersion in a water, which dispersion is comprised of a pigment, an ionic surfactant and optionally a charge control agent;

(ii) shearing the pigment dispersion with a latex mixture comprised of containing the polymeric particles in water and counterionic surfactant with a charge polarity of opposite sign to that of said ionic surfactant, a nonionic surfactant and resin particles;

(iii) heating the resulting homogenized mixture in the temperature range of from about 0° C. to about plus 10° C. above the resin Tg thereby causing flocculation or heterocoagulation of the formed particles of pigment, resin and charge control agent to form electrostatically bounded toner size aggregates; and (iv) heating to from about 65 to about 95° C. the statically bound aggregated particles of (iii) to form said toner composition comprised of polymeric resin and pigment.

Also, in embodiments the present invention is directed to processes for the preparation of toner compositions which comprises (i) preparing an ionic pigment mixture by dispersing a pigment, such as carbon black like REGAL 330®, HOSTAPERM PINK TM, or PV FAST BLUE TM of from about 2 to about 10 percent by weight of toner in an aqueous mixture containing a cationic surfactant such as dialkylbenzene dialkylammonium chloride like SANIZOL B-50 TM available from Kao or MIRAPOL TM available from Alkaril Chemicals, and from about 0.5 to about 2 percent by weight of water, utilizing a high shearing device, such as a Brinkman Polytron or IKA homogenizer, at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE TM or poly(styrenebutadiene), and which resin particles are present in various effective amounts such as from about 40 percent to about 98 percent by weight of the toner; and wherein the polymer resin latex particle size is from about 0.1 micron to about 3 microns in average volume diameter, and counterionic surfactant such as an anionic surfactant like sodium dodecylsulfate, dodecylbenzene sulfonate or NEOGEN R TM from about 0.5 to about 2 percent by weight of water, a nonionic surfactant, such polyethylene glycol or polyoxyethylene glycol nonyl phenyl ether or IGEPAL 897 TM obtained from GAF Chemical Company, from about 0.5 to about 3 percent by weight of water, thereby causing a flocculation or heterocoagulation of pigment, charge control additive and resin particles; (iii) diluting the mixture with water to from about 50 percent solids to about 15 percent solids; (iv) homogenizing the resulting flocculent mixture with a high shearing device, such as a Brinkman Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer from about 250 to about 500 rpm in the temperature range of about zero (0) to plus 10° C. above the resin Tg to form electrostatically stable aggregates of from about 5 microns to about 10 microns in volume average diameter; (v) adding additional anionic surfactant or nonionic surfactant in the amount of from 0.5 percent to 5 percent by weight of the water to stabilize the aggregates formed in the previous step (iv); (vi) heating the statically bound aggregate composite particles at from about 65° C. to about 95° C. for a duration of about 60 minutes to about 600 minutes to form toner sized particles of from about 5 microns to about 10 microns in volume average diameter and with a geometric size distribution of from about 1.16 to about 1.26 as measured by the Coulter Counter; and (vii) isolating the toner sized particles by washing, filtering and drying thereby providing composite particles comprised of resin and pigment toner composition. Flow additives to improve flow characteristics and charge additives to improve charging characteristics may then optionally be added by blending with the formed toner, such additives including AEROSILS TM or silicas, metal oxides like tin, titanium and the like, metal salts of fatty acids like zinc stearate, and which additives can be present in various effective amounts, such as from about 0.1 to about 10 percent by weight of the toner.

One preferred method of obtaining the pigment dispersion depends primarily on the form of the pigment utilized. In some instances, pigments available in the wet cake form or concentrated form containing water can be easily dispersed utilizing a homogenizer or stirring. In other instances, pigments are available in a dry form, whereby dispersion in water is preferably effected by microfluidizing using, for example, a M-110 microfluidizer and passing the pigment dispersion from 1 to 10 times through the chamber of the microfluidizer, or by sonication, such as using a Branson 700 sonicator, with the optional addition of dispersing agents such as the aforementioned ionic or nonionic surfactants.

In embodiments, the present invention relates to a process for the preparation of toner compositions with controlled particle size comprising:

(i) preparing a pigment dispersion in water, which dispersion is comprised of a pigment, an ionic surfactant and optionally a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the system; and wherein in embodiments the solids concentration is about 12 percent;

(iii) heating the above in the sensitive region of the resin Tg in the temperature range of from about 5° C. to about 8° C. above the resin Tg while continuously stirring to form electrostatically bounded relatively stable (for Coulter Counter measurements) toner size aggregates with narrow particle size distribution;

(iv) heating, for example, from about 66° C. to about 95° C. the statically bound aggregated particles or at temperatures between 10° C. and 40° C. above the Tg of the resin, which Tg is from about 45° C. to about 60° C., and preferably 54° C. to produce a mechanically stable, morphologically useful forms of the toner composition comprised of polymeric resin, pigment and optionally a charge control agent;

(v) optionally separating the toner particles from the water by filtration; and (vi) drying the toner particles.

Embodiments of the present invention include a process for the preparation of toner compositions with controlled particle size comprising:

(i) preparing a pigment dispersion in water, which dispersion is comprised of a pigment of a diameter of from about 0.01 to about 1 micron, an ionic surfactant and optionally a charge control agent;

(ii) shearing the pigment dispersion with a latex blend comprised of resin particles of submicron size of from about 0.01 to about 1 micron, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactant system;

(iii) heating the above sheared blend at a temperature in the range of from about 5° C. to about 10° C. above the resin Tg while continuously stirring to form electrostatically bounded relatively stable (for Coulter Counter measurements) toner size aggregates with a narrow particle size distribution;

(iv) heating the statically bound aggregated particles at a temperature of from about 11° C. to about 50° C. above the Tg of the resin to provide a mechanically stable toner composition comprised of polymeric resin, pigment and optionally a charge control agent;

(v) separating the toner particles by filtration; and (vi) drying the toner particles; a process for the preparation of toner compositions with controlled particle size comprising:

(i) preparing a pigment dispersion in water, which dispersion is comprised of a pigment, an ionic surfactant, optionally a charge control agent, and other known toner additions;

(ii) shearing the pigment dispersion with a latex blend comprised of resin particles of submicron size, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactant;

(iii) heating the above sheared blend above about glass transition temperature (Tg) of the resin particles while continuously stirring to form electrostatically bounded toner size aggregates with a narrow particle size distribution;

(iv) heating the statically bound aggregated particles above, for example from 11° C. to 50° C., the resin Tg to provide a toner composition comprised of polymeric resin, pigment and optionally a charge control agent; and a process for the preparation of toner compositions comprising:

(i) preparing a pigment dispersion, which dispersion is comprised of a pigment, an ionic surfactant, and optionally a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in water and surfactants where the solids concentration is 12 percent in embodiments;

(iii) heating the above sheared blend at a critical temperature region about above the glass transition temperature (Tg) of the resin while continuously stirring to form electrostatically bounded toner size aggregates with a narrow particle size distribution and wherein said critical temperature is from about 5° C. to about 10° C. above the resin Tg, and wherein the resin Tg is from about 30° C. to about 65° C. and preferably in the range of from about 45° C. to about 65° C.;

(iv) heating the statically bound aggregated particles above the Tg of the resin particles to provide a toner composition comprised of polymeric resin, pigment and optionally a charge control agent;

(v) optionally separating the toner; and (vi) drying the toner.

Toner and developer compositions thereof are also encompassed by the present invention in embodiments.

Illustrative examples of specific resin particles selected for the process of the present invention include known polymers selected from the group consisting of poly(styrene-butadiene), poly(para-methyl styrenebutadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(-butylmethacrylate-butadiene), poly(methylacrylate-butadiene), poly(ethylacrylate-butadiene), poly(-propylacrylate-butadiene), poly(butylacrylate-butadiene), poly(styrene-isoprene), poly(para-methyl styrene-isoprene), poly(meta-methyl styrene-isoprene), poly(alphamethylstyrene-isoprene), poly (methylmethacrylate-isoprene), poly(ethylmethacrylate-isoprene), poly(-propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers such as poly(styrene-butadieneacrylic acid), poly(styrene-butadiene-methacrylic acid), PLIOTONE TM available from Goodyear, polyethylene-terephthalate, polypropylene-teterephthalate, polybutylene-terephthalate, polypentylene-terephthalate, polyhexalene-terephthalate, polyheptadene-terephthalate, poiyoctaleneterephthalate, POLYLITE TM (Reichhold Chemical Inc), PLASTHALL TM (Rohm & Hass), CYGAL TM (American Cyanamide), ARMCO TM (Armco Composites), ARPOL TM (Ashland Chemical), CELANEX TM (Celanese Eng), RYNITE TM (DuPont), and STYPOL TM. The resin particles selected, which generally can be in embodiments styrene acrylates, styrene butadienes, styrene methacrylates, or polyesters, are present in various effective amounts, such as from about 70 to about 98, and preferably from about 85 weight percent to about 98 weight percent of the toner, and can be of small average particle size such as from about 0.01 micron to about 1 micron in volume average diameter as measured by the Brookhaven nanosize particle analyzer.

The resin, or resin particles selected for the process of the present invention are preferably prepared from emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional and such groups can be present in various amounts of from about 0.1 to about 10 percent by weight of the polymer resin. Known chain transfer agents, for example dodecanethiol (1 to 10 percent), or carbon tetrabromide in effective amounts, such as from about 1 to about 10 percent, can also be selected when preparing resin particles by emulsion polymerization. Other processes of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654 (D/92277), the disclosure of which is totally incorporated herein by reference, mechanical grinding processes, or other known processes.

Various known colorants or pigments present in the toner in an effective amount of, for example, from about I to about 25 percent by weight of the toner, and preferably in an amount of from about 1 to about 15 weight percent, that can be selected include carbon black, like REGAL 330®, REGAL 660®, REGAL 400®, REGAL 400 ®, and REGAL 330R®, REGAL 660R®and other equivalent black pigments. As colored pigments there can be selected known cyan, magenta, red, green, blue, brown, yellow, or mixtures thereof. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E.I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments selected are present in various effective amounts, such as from about 1 weight percent to about 65 weight percent and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in amounts of, for example, from about 0.1 to about 25 weight percent in embodiments, and preferably 1 to about 10 weight percent in embodiments include, for example, nonionic surfactants such as dialkylphenoxypoly(ethyteneoxy) ethanol available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is also, for example, in embodiments of from about 0.01 to about 10 percent by weight, and preferably from about 0.1 to about 5 percent by weight of the monomers used to prepare the polymer resin.

Examples of anionic surfactants include, for example, sodium dodecylsulfate (SDS), sodium dodecylbenzene sulfonate, sodium dodecylnaphthalene sulfate, dialkyl benzenealkyl, sulfates and sulfonates, abetic acid, available from Aldrich, NEOGEN R TM, NEOGEN SC TM obtained from Kao and the like. An effective concentration of the anionic surfactant generally employed is, for example, from about 0.01 to about 10 percent by weight, and preferably from about 0.1 to about 5 percent by weight of monomers used to prepare the polymer resin particles.

Examples of cationic surfactants selected for the toners and processes of the present invention include, for example, dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$,$C_{17}$ trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as for example from about 0.1 percent to about 5 percent by weight of water. Preferably the molar ratio of the cationic surfactant used for flocculation to the anionic surfactant used in the latex preparation is in the range of from about 0.5 to about 4, and preferably from 0.5 to 2.

Examples of the surfactant which are added to the aggregated particles to "freeze" or retain particle size and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM obtained from Kao and the like. They can also be selected from the group of nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the resin latex, pigment particles, water, ionic and nonionic surfactants mixture.

Surface additives that can be added to the toner compositions after washing or drying include, for example, those mentioned herein such as metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

The following Examples are being submitted to further define various species of the present invention. These Examples are intended to be illustrative only and are not intended to limit the scope of the present invention. Also, parts and percentages are by weight unless otherwise indicated.

EXAMPLES

Preparation of the Toner Resin

The latex was prepared by an emulsion polymerization process which latex was selected for the preparation of toner particles in the aggregation process of the present invention.

Latex A 9,840 G ams of styrene, 2,160 grams of butyl acrylate, 240 grams of acrylic acid, 120 grams of carbon tetrabromide and 420 grams of dodecanethiol were mixed with 18,000 grams of deionized water in which 270 grams of sodium dodecyl benzene sulfonate (SDBS) anionic surfactant (NEOGEN R TM which contains 60 percent of active SDBS and 40 percent water component), 258 grams of polyoxyethylene nonyl phenyl ether nonionic surfactant (ANTAROX 897 TM, 70 percent active, polyethoxylated alkylphenols), and 120 grams of ammonium persulfate initiator were dissolved. The emulsion was then polymerized at 80° C. for 5 hours. A latex containing 60 percent water and 40 percent solids of polymeric particles comprised of a copolymer of styrene, butylacrylate and acrylic acid with a particle size of 160 nanometers, as measured on Brookhaven nanosizer, was obtained. The solids were Tg=54° C., as measured on DuPont DSC; $M_w$=19,600, and $M_n$=5,700 as determined on Hewlett Packard GPC. The aforementioned latex was then selected for the toner preparation of Examples I to VI as indicated where the aggregation steps were performed in the critical temperature regions of 53 to 64° C.

PREPARATION OF THE PIGMENT DISPERSION

Pigment Dispersion B 280 grams of dry PV FAST BLUE TM pigment and 58.5 grams of the cationic surfactant SANIZOL B-50 TM were suspended in 8,000 grams of distilled water, and subsequently passed through a microfluidizer until the dispersion was homogeneous. This mixture was then utilized to form the toner in Examples I to VII as indicated.

PREPARATION OF TONER PARTICLES

EXAMPLE I

417 Grams of the above prepared PV FAST BLUE TM dispersion (Pigment B) and 650 grams of the latex (Latex A) were simultaneously added into a SD-41 continuous blending device which contained 1,200 grams of water. Homogenization was achieved by recirculating the contents of the SD-41 continuously through the shearing chamber at 10,000 rpm for 8 minutes. The resulting product was then transferred to a controlled temperature kettle and heated at 53° C. while gently stirring for 1.5 hours. The aggregate produced had a diameter (average volume) of 7.1 microns with a GSD of 1.20 as determined by particle diameter measurements using the Coulter Counter (Microsizer I1). At this point, 40 grams of a 20 percent by weight solution of NEOGEN R TM in water were added to the kettle contents to prevent the formed aggregates from further aggregating and increasing in size during the following coalescence stage of the process.

The kettle contents were then heated to 85° C. while stirring for about 4 hours. The particle size was measured on the Coulter Counter. Particles of 7.1 microns were obtained with a GSD =1.19, indicating no further growth in the particle size. The toner particles were then washed with water and dried. The aforementioned cyan toner was comprised of 94.5 percent of 88 parts of polystyrene, 12 parts of polybutylacrylate, 2 parts of polyacrylic acid and 5.5 percent of phthalocyanine PV FAST BLUE TM pigment particles. The yield of the toner particles was 98.5 percent.

EXAMPLE II

417 Grams of the above PV FAST BLUE TM dispersion (Pigment B) and 650 grams of the above latex (Latex A) were simultaneously added into a SD-41 continuous blending device which contained 1,200 grams of water. Homogenization was achieved by recirculating the contents of the SD-41 continuously through the shearing chamber at 10,000 rpm for 8 minutes. The resulting product was then transferred to a controlled temperature kettle and heated at 56° C. while gently stirring for 1.5 hours. The aggregate produced had a diameter of 8.1 microns with a GSD of 1.21 as determined by particle diameter measurements using the Coulter Counter (Microsizer II). At this point, 40 grams of a 20 percent by weight solution of NEOGEN R TM in water was added to the kettle content to prevent the formed aggregates from further aggregating and increasing in size during the following coalescence stage of the process.

The kettle contents were then heated to 85° C. while stirring for about 4 hours. The particle size was measured on the Coulter Counter. Particles of 8.2 microns were obtained with a GSD =1.19 indicating no further growth in the particle size. The particles were then washed with water and dried. The aforementioned cyan toner was comprised of 94.5 percent of 88 parts of polystyrene, 12 parts of polybutylacrylate, 2 parts of polyacrylic acid and 5.5 percent of phthalocyanine pigment particles. The yield of toner was 98 percent.

EXAMPLE III

417 Grams of the PV FAST BLUE TM dispersion (Pigment B) and 650 grams of the latex (Latex A) were simultaneously added into a SD-41 continuous blending device which contained 1,200 grams of water. Homogenization was achieved by recirculating the contents of the 5D-41 continuously through the shearing chamber at 10,000 rpm for 8 minutes. The resulting product was then transferred to a controlled temperature kettle and heated at 58° C. while gently stirring for 80 minutes. The aggregate produced had a diameter of 8.8 microns with a GSD of 1.21 as determined by particle diameter measurements using the Coulter Counter (Microsizer II). Forty (40) grams of a 20 percent by weight solution of NEOGEN R TM in water was added to the kettle content to prevent the formed aggregates from further aggregating and increasing in size during the following coalescence stage of the process.

The kettle contents were then heated to 85° C. while stirring for about 4 hours. The particle size was measured again on the Coulter Counter. Toner particles of 8.7 microns were obtained with a GSD =1.22, indicating no further growth in the particle size. The particles were then washed with water and dried. The aforementioned cyan toner was comprised of 94.5 percent of 88 parts of polystyrene, 12 parts of polybutylacrylate, 2 parts of polyacrylic acid and 5.5 percent of phthalocyanine pigment particles. The yield of toner was 98 percent.

EXAMPLE IV

417 Grams of the PV FAST BLUE TM dispersion (Pigment B) and 650 grams of the latex (Latex A) were simultaneously added into a SD-41 continuous blending device which contained 1,200 grams of water. Homogenization was achieved by recirculating the contents of the SD-41 continuously through the shearing chamber at 10,000 rpm for 8 minutes. The resulting product was then transferred to a controlled temperature kettle and heated at 61° C. while gently stirring for 1 hour. The aggregate produced had a diameter of 9.3 microns with a GSD of 1.20 as determined by particle diameter measurements using the Coulter Counter (Microsizer II). At this point 40 grams of a 20 percent by weight solution of NEOGEN R TM in water was added to the kettle contents.

The kettle contents were then heated to 85° C. while stirring for about 4 hours. The particle size was measured again on the Coulter Counter. Toner particles of 9.4 microns were obtained with a GSD =1.19, indicating no further growth in the particle size. The particles were then washed with water and dried. The aforementioned cyan toner was comprised of 94.5 percent of 88 parts of polystyrene, 12 parts of polybutylacrylate, 2 parts of polyacrylic acid and 5.5 percent of PV FAST BLUE TM phthalocyanine pigment particles. The yield of toner particles was 99 percent.

EXAMPLE V

417 Grams of the PV FAST BLUE TM dispersion (Pigment B) and 650 grams of the latex (Latex A) were simultaneously added into a SD-41 continuous blending device which contained 1,200 grams of water. Homogenization was achieved by recirculating the contents of the SD-41 continuously through the shearing chamber at 10,000 rpm for 8 minutes. The resulting product was then transferred to a controlled temperature kettle and heated at 62° C while gently stirring for 45 minutes. The aggregate produced had a diameter of 9.75 microns with a GSD of 1.19 as determined by particle diameter measurements using the Coulter Counter (Microsizer II). At this point 40 grams of a 20 percent by weight solution of NEOGEN R TM in water was added to the kettle content to prevent the formed aggregates from further aggregating and increasing in size.

The kettle contents were then heated to 85° C. while stirring for about 4 hours. The particle size was measured on the Coulter Counter. Particles of 9.8 microns were obtained with a GSD =1.18, indicating no further growth in the particle size. The toner particles were then washed with water and dried. The aforementioned cyan toner was comprised of 94.5 percent of 88 parts of polystyrene, 12 parts of polybutylacrylate, 2 parts of polyacrylic acid and 5.5 percent of phthalocyanine pigment particles. The yield of toner particles was 99 percent.

EXAMPLE VI

417 Grams of the PV FAST BLUE TM dispersion (Pigment B) and 650 grams of the latex (Latex A) were simultaneously added into a SD-41 continuous blending device which contained 1,200 grams of water. Homogenization was achieved by recirculating the contents of the SD-41 continuously through the shearing chamber at 10,000 rpm for 8 minutes. The resulting product was then transferred to a controlled temperature kettle and heated at 64° C. while gently stirring for 45 minutes. The aggregate produced had a diameter of 10.3 microns with a GSD of 1.20 as determined by particle diameter measurements using the Coulter Counter (Microsizer II). At this point, 40 grams of a 20 percent by weight solution of NEOGEN R TM in water was added to the kettle contents.

The kettle contents were then heated to 85° C. while stirring for about 4 hours. The particle size was measured on the Coulter Counter. Toner particles of 10.4 microns were obtained with a GSD=1.19, indicating no further growth in the particle size. The particles were then washed with water and dried. The aforementioned cyan toner was comprised of 94.5 percent of 88 parts of polystyrene, 12 parts of polybutylacrylate, 2 parts of polyacrylic acid and 5.5 percent of phthalocyanine pigment particles. The yield of toner was 98 percent.

TABLE 1

| Sample # | Aggregation Temperature | Particle Size | GSD |
|---|---|---|---|
| I | 53° C. | 7.1 | 1.19 |
| II | 56° C. | 8.2 | 1.19 |
| III | 58° C. | 8.7 | 1.22 |
| IV | 61° C. | 9.4 | 1.19 |
| V | 62° C. | 9.8 | 1.18 |
| VI | 64° C. | 10.4 | 1.19 |

The above Table illustrates the change in particle size as the aggregation temperature is increased.

Other embodiments and modifications of the present invention may occur to those skilled in the art subsequent to a review of the information presented herein; these embodiments and modifications, as well as equivalents thereof, are also included within the scope of the present invention.

What is claimed is:

1. A process for the preparation of toner compositions comprising:

(i) preparing a pigment dispersion in water, which dispersion is comprised of a pigment, an ionic surfactant and optionally a charge control agent;

(ii) shearing the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, resin and optional charge control agent to form a uniform dispersion of solids in the water, and surfactant;

(iii) heating the uniform disperion of solids in water and surfactant of (ii) at a critical temperature region about equal to or above the glass transition temperature (Tg) of the resin, while continuously stirring, to form electrostatically bounded toner size aggregates with a narrow particle size distribution and wherein said critical temperature is from about 0° C. to about 10° C. above the resin Tg, and wherein the resin Tg is from about 30° C. to about 65° C. and preferably in the range of from about 45° C. to about 65° C.;

(iv) heating the electrostatically bounded toner size aggregates from about 10° C. to about 45° C. above the Tg of the resin particles to provide a toner composition comprised of polymeric resin, pigment and optionally a charge control agent; and (v) optionally separating and drying said toner.

2. A process in accordance with claim 1 wherein the temperature of the stirring in the critical resin Tg temperature region (iii) controls the size of the aggregated particles in the range of from about 4 to about 15 microns in average volume diameter.

3. A process in accordance with claim 1 wherein aggregate particles with narrow size distribution are obtained by performing step (iii) for from about 1 to about 2 hours, and wherein the temperature above the resin Tg is about 10° C.

4. A process in accordance with claim 1 wherein toner with a particle size of about 4 to about 15 microns in average volume diameter can be obtained by performing step (iii) within from about 5° C. to about 10° C. of the resin Tg.

5. A process in accordance with claim 1 wherein the aggregation in (iii) is kinetically controlled.

6. A process in accordance with claim 1 wherein the ionic surfactant utilized in preparing the pigment dispersion is a cationic surfactant, and the counterionic surfactant, which is an anionic surfactant, is present in the latex mixture.

7. A process in accordance with claim 1 wherein the dispersion of step (i) is accomplished by homogenizing at from about 1,000 revolution per minute to about 10,000 revolutions per minute, or by microfluidization in a microfluidizer or in nanojet, or by an ultrasonic probe at from about 300 watts to about 900 watts of energy at a temperature of from about 25° C. to about 35° C. for a duration of from about 1 minute to about 120 minutes.

8. A process in accordance with claim 1 wherein the homogenization (ii) is accomplished by homogenizing at from about 1,000 revolution per minute to about 10,000 revolutions per minute for a duration of from about 1 minute to about 120 minutes.

9. A process in accordance with claim 1 wherein the heating of the blend of latex, pigment, surfactants and optional charge control agent in step (iii) is accomplished at temperatures of from about 5° C. to about 8° C. above the resin Tg for a duration of from about 0.5 hour to about 6 hours.

10. A process in accordance with claim 1 wherein the heating of the statically bound aggregate particles to form toner size composite particles comprised of pigment, resin and optional charge control agent is accomplished at a temperature of from about 15° C. to about 95° C. above the Tg of the resin for a duration of from about 1 to about 8 hours.

11. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylatebutadiene), poly(ethylmethacrylate-butadiene), poly(propylmethacrylatebutadiene), poly(butylmethacrylate-butadiene), poly(methylacrylatebutadiene), poly(ethylacrylate-butadiene), poly(propylacrylate-butadiene), poly(butylacrylate-butadiene), poly(styrene-isoprene), poly(paramethylstyrene-isoprene), poly(metamethylstyrene-isoprene), poly(alphamethylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrytate-isoprene).

12. A process in accordance with claim 1 wherein the resin is selected from the group consisting of poly(styrene-butadiene-acrylic acid), poly(styrene-butadiene-methacrylic acid), poly(styrene-butyl methacrylateacrylic acid), poly(styrene-butyl acrylate-acrylic acid), polyethyleneterephthalate, polypropylene-terephthalate, polybutylene-terephthalate, polypentylene-terephthalate, polyhexalene-terephthalate, polyheptadeneterephthalate, and polyoctalene-terephthalate.

13. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

14. A process in accordance with claim 1 wherein the anionic surfactant is selected from the group consisting of sodium dodecyl sulfate, sodium dodecylbenzene sulfate, and sodium dodecylnaphthalene sulfate.

15. A process in accordance with claim 6 wherein the cationic surfactant is a quaternary ammonium salt.

16. A process in accordance with claim 1 wherein the pigment is carbon black, cyan, yellow, magenta, red, blue, green, brown, or mixtures thereof.

17. A process in accordance with claim 1 wherein the resin utilized in (ii) is from about 0.01 to 3 microns in volume average diameter, and the pigment particles are from about 0.01 to about 1 micron in average volume diameter.

18. A process in accordance with claim 1 wherein the pigment particles are from about 0.01 to about 3 microns in average volume diameter.

19. A process for the preparation of toner compositions with controlled particle size comprising:

(i) preparing a pigment dispersion in water, which dispersion is comprised of a pigment and an ionic surfactant;

(ii) shearing the pigment dispersion with a latex blend comprised of resin particles of submicron size, a counterionic surfactant with a charge polarity of opposite sign to that of said ionic surfactant, and which blend contains a nonionic surfactant thereby causing a flocculation or heterocoagulation of the formed particles of pigment;

(iii) heating the formed particles of pigment of (ii) in a critical temperature region or above the glass transition temperature (Tg) of the resin particles thereby forming aggregated particles of resin and pigment;

(iv) heating the formed aggregated particles of (iii) about above the resin glass transition temperature (Tg) to provide a toner composition comprised of polymeric resin, and pigment; and (v) optionally separating and drying the toner product.

20. A process in accordance with claim 1 wherein in (ii) the solids concentration is about 12 percent.

21. A process in accordance with claim 1 wherein the heating in (iii) is accomplished at a temperature of from about 53° C. to about 64° C.

* * * * *